United States Patent [19]

de Nora et al.

[11] 4,267,025

[45] May 12, 1981

[54] ELECTRODES FOR ELECTROLYTIC PROCESSES, ESPECIALLY PERCHLORATE PRODUCTION

[75] Inventors: Vittorio de Nora, Nassau, The Bahamas; Antonio Nidola, Milan, Italy; Placido M. Spaziante, Lugano, Switzerland; Giuseppe Bianchi, Milan, Italy

[73] Assignee: Diamond Shamrock Technologies, S.A., Geneva, Switzerland

[21] Appl. No.: 97,360

[22] Filed: Nov. 26, 1979

[51] Int. Cl.[3] ..... C25B 1/26; C25B 1/28; C25B 11/08

[52] U.S. Cl. ..... 204/82; 204/95; 204/290 R; 204/292

[58] Field of Search ..... 204/290 R, 291, 292, 204/82, 95

[56] References Cited

U.S. PATENT DOCUMENTS

| | | | |
|---|---|---|---|
| 3,475,301 | 10/1969 | Cook et al. | 204/82 |
| 4,118,307 | 10/1978 | LaBarre | 204/290 R |
| 4,146,438 | 3/1979 | de Nora et al. | 204/290 F |

*Primary Examiner*—Howard S. Williams
*Attorney, Agent, or Firm*—John P. Hazzard

[57] ABSTRACT

An electrode especially for the production of chlorates and perchlorates comprising an electrically-conductive corrosion-resistant substrate having an electrocatalytic coating which is preferably a mixture of 40 to 85 parts by weight of platinum, 0 to 20 parts by weight of palladium and 15 to 40 parts by weight (as tin metal) of tin dioxide.

8 Claims, 2 Drawing Figures

Faraday efficiency non wanted oxygen evolution side reaction (%)
0
10
20
30
40
10 20 30 40 50 60 70 80 90 100
% Sn in Pt/SnO2 coating oxygen evolution faraday efficiency (%)
0
10
20
30
10 20 30 40 50 60 70
Pd content (%)

ELECTRODES FOR ELECTROLYTIC PROCESSES, ESPECIALLY PERCHLORATE PRODUCTION

TECHNICAL FIELD

The invention relates to electrodes for use in electrolytic processes, of the type comprising an electrically-conductive and corrosion-resistant substrate having an electrocatalytically-active surface coating, and to electrolytic processes using such electrodes, especially (but not exclusively) as anodes for the production of chlorates, perchlorates and other persalts and percompounds including organic peroxyacids.

BACKGROUND ART

For the production of perchlorate, various anode materials have been used commercially, including smooth massive platinum, platinized titanium or tantalum (despite a tendency to produce excess oxygen) and lead dioxide coated on titanium or graphite, although these lead dioxide anodes have a high overvoltage and wear rapidly.

Some proposals have already been made to combine platinum group metals and tin dioxide in electrode coating materials. For example, U.S. Pat. No. 3,701,724 mentioned an anode for chlorine production having a coating consisting essentially of a minor amount of a platinum group metal and/or platinum group metal oxides with a major amount of $SnO_2$, $Sb_2O_5$, $Sb_2O_3$ or $GeO_2$ and mixtures thereof. However, the claims and examples of this patent are directed solely to such coatings containing platinum group metal oxides and there is no enabling disclosure of a coating containing a platinum group metal. Also, U.S. Pat. No. 3,882,002 proposed an anode for chlorine production having a valve metal substrate coated with an intermediate layer of tin dioxide which was covered with an outer layer of a platinum group metal or oxide thereof. Neither of these proposals was directed to improving electrolytic performance in the production of percompounds.

DISCLOSURE OF INVENTION

An object of the invention therefore is to provide an improved electrode suitable for use as an anode for the production of perchlorates and other persalts, but which may also be used in other applications, such as chlorate production.

According to a main aspect of the invention, an electrode comprises an electrically-conductive corrosion-resistant substrate having an electrocatalytic coating and is characterized in that the coating contains a mixture of at least one platinum group metal and tin dioxide dispersed in one another throughout the coating in the ratio of 8.5:1 to 3:2 by weight of the platinum group metals to the tin (as metal) of the tin dioxide.

The platinum group metal/tin dioxide coating may also contain a stabilizer/binder, for example a compound such as titanium dioxide, zirconium dioxide or silicon dioxide. Additionally, the coating may include a filler, e.g. particles or fibres of an inert material, such as silica or alumina, particles of titanium, or zirconium silicate. Furthermore, the coating may also contain, e.g. as a dopant the tin dioxide in a quantity up to about 30% by weight (as metal) of the tin dioxide, of at least one additional metal or oxide of zinc, cadmium, arsenic, antimony, bismuth, selenium and tellurium. Such stabilizers or binders, fillers and dopants generally do not account for more than 70% of the total weight of the coating, usually far less. In the case of antimony trioxide or bismuth trioxide as dopant, the preferred amount corresponds to a ratio expressed as parts by weight of Sb/Bi:Sn (as metal) of at most about 1:4 to about 1:10 or even as low as 1:100.

The platinum group metals are ruthenium, rhodium, palladium, osmium, iridium and platinum. Platinum is the preferred platinum group metal in the coating, when a single metal is present, especially in anodes for perchlorate production. However, it is understood that alloys such as platinum-iridium and platinum-rhodium, also are useful for other applications. An alloy of platinum-palladium containing up to 20% palladium by weight of the alloy has given very satisfactory results for perchlorate production. Also, in some instances, it may be advantageous to alloy the platinum group metal(s) with one or more non-platinum group metals, for example an alloy or an intermetallic compound with one of the valve metals titanium, zirconium, hafnium, vanadium, niobium and tantalum, or with another transition metal, for example a metal such as tungsten, manganese or cobalt.

The substrate may consist of any of the aforementioned valve metals or alloys thereof, porous sintered titanium being preferred. However, other electrically-conductive and corrosion-resistant substrates may be used, such as expanded graphite.

The platinum group metal(s) and tin dioxide with possible additional dopants, such as antimony trioxide or bismuth trioxide, may be co-deposited chemically from solutions of appropriate salts which are painted, sprayed or otherwise applied on the substrate and then subjected to heat treatment, this process being repeated until a sufficiently thick layer has been built up.

Alternatively, thin layers of different components (e.g. alternate platinum or Pt/Pd alloy layers and layers of pure or doped tin dioxide) can be built up in such a way that the components are effectively mixed and dispersed in one another throughout the coating, possibly with diffusion between the layers, in contrast to the known prior art coatings such as that of U.S. Pat. No. 3,882,002, in which the tin dioxide was applied as a separate intermediate layer covered by a platinum group metal. Using this procedure of applying alternate layers, it is possible to deposit thin layers of platinum galvanically, which is advantageous, because galvanically-deposited platinum has a lower oxygen evolution potential than chemi-deposited platinum.

The platinum-group metal or alloy/tin dioxide layer may be applied directly to the substrate, or to an intermediate layer, e.g. of co-deposited tin and antimony oxides or tin and bismuth oxides, or to intermediate layers consisting of one or more platinum group metals or their oxides, mixtures or mixed crystals of platinum group metals and valve metal oxides, intermetallics of platinum group metals and non-platinum group metals, and so forth.

In a preferred embodiment, the coating comprises 40 to 85 parts by weight of platinum, 0 to 20 parts by weight of palladium and 15 to 40 parts by weight (as Sn metal) of tin dioxide on a titanium, tantalum or titanium-tantalum alloy substrate. This embodiment of an electrode of the invention, when used as anode for perchlorate or persulphate production, has been found to have selective properties favouring the persalt production while hindering oxygen evolution. The platinum metal acts as a catalyst for persalt production. The tin dioxide acts as an oxygen evolution inhibitor by blocking peroxide decomposition, which can be regarded as the intermediate step of the unwanted oxygen evolution reaction. Finally, the palladium acts as a diluent for the relatively more expensive platinum, without adversely affecting the oxygen inhibition effect of the tin dioxide.

Another aspect of the invention is a process for the production of chlorates, perchlorates and other percompounds, e.g. persulphates, which is characterised by using as anode an electrode according to the invention, as defined above.

BEST MODES FOR CARRYING OUT THE INVENTION

The following Examples are given to illustrate the invention.

EXAMPLE I

Titanium coupons measuring 10×10×1 mm were sandblasted and etched in 20% hydrochloric acid and were thoroughly washed in water. The coupons were then coated with an aqueous solution of chlorides of platinum and tin in different weight ratios, dried at 95° to 100° C. and then heated at 450° C. for 15 minutes in an oven with forced air ventilation. The procedure was repeated five times and the coupons were given a final heat treatment at 450° C. for 60 minutes. The coatings so produced contained $SnO_2$ and platinum metal dispersed in one another.

Figure 1:
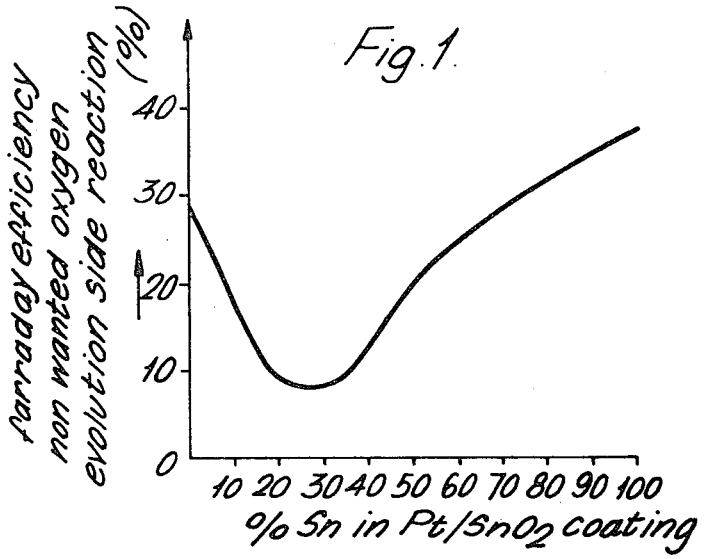
FIG. 1 shows a graph of the faraday efficiency of oxygen evolution as ordinate plotted against the tin content of the electrode coating as abscissa, the electrode being that described below in detail in Example I.

The coated coupons were tested as anodes for the production of sodium perchlorate by the electrolysis of a solution consisting of 100 g/l $NaClO_3$, 400 g/l $NaClO_4$ and 5 g/l $Na_2CrO_4$ at 30° C. using a stainless steel cathode and a current density of 2 KA/m$^2$. Sodium chlorate was supplied and sodium perchlorate removed to maintain the concentrations in the electrolyte at a steady state. The faraday efficiency of the oxygen evolution reaction (i.e. the unwanted side reaction in perchlorate production) was measured as a function of the percentage by weight of tin (as metal) in the mixed Pt-$SnO_2$ coating. The results obtained are shown in FIG. 1, from which it can be seen that there is an optimum oxygen-inhibition effect for a tin content in the range of about 25%–35% of the total weight of tin and platinum metals, and a very appreciable inhibition of oxygen evolution for a tin content in the larger range from about 15% to about 40%.

EXAMPLE II

Titanium coupons were coated as in Example I, but using various coating solutions containing platinum, palladium and tin chlorides, to produce mixed Pt-Pd-$SnO_2$ coatings having compositions as follows:

| Coating Composition (% weight of metal) | | |
|---|---|---|
| Pt | Pd | $SnO_2$ |
| 70 | 0 | 30 |
| 65 | 5 | 30 |
| 60 | 10 | 30 |
| 55 | 15 | 30 |
| 50 | 20 | 30 |
| 45 | 25 | 30 |

Figure 2:
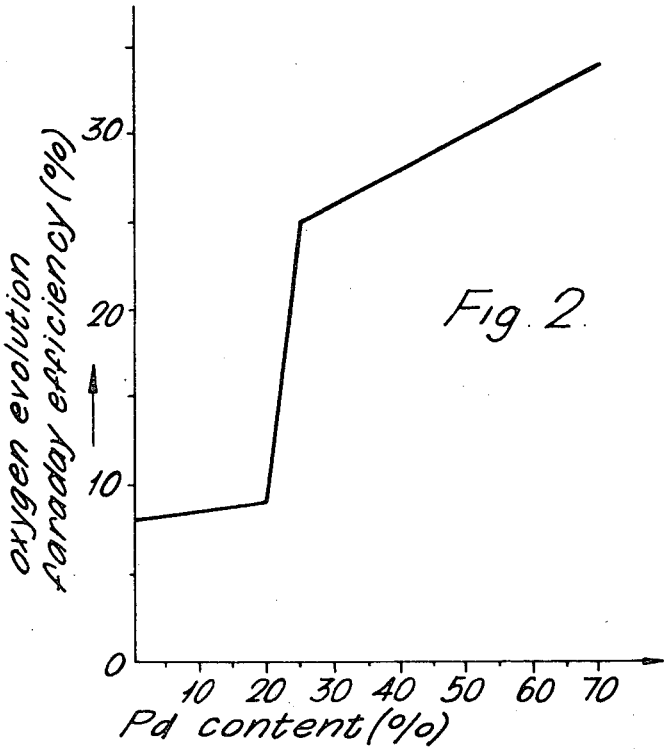
FIG. 2 shows a graph of the faraday efficiency of oxygen evolution as ordinate plotted against the palladium content of the electrode coating as abscissa, the electrode being that described below in detail in Example II.

These coupons were tested as anodes for perchlorate production under the same conditions as used in Example I. The faraday efficiency of the unwanted oxygen evolution reaction was measured as a function of the palladium metal content, and the results are shown in FIG. 2. This graph shows that, for a palladium content up to 20%, the faraday efficiency remained low, i.e. the palladium did not adversely affect the performance of the coating to inhibit oxygen evolution. However, above the critical Pd content of 20%, the faraday efficiency abruptly increased, the stability of the coating was lowered and some electrochemical corrosion took place.

The coatings of Examples I and II were tested at different current densities, and it was found that the oxygen evolution faraday efficiency decreased with increasing current density up to about 2 KA/m$^2$, then remained stable above 2 KA/m$^2$.

We claim:

1. An electrode for use in electrolytic processes, comprising an electrically-conductive corrosion-resistant substrate having an electrocatalytic coating, characterized in that the coating contains a mixture of at least one platinum group metal and tin dioxide dispersed in one another throughout the coating in the ratio of from 8.5:1 to 3:2 by weight of the platinum group metal(s) to the tin of the tin dioxide.

2. The electrode of claim 1, characterized in that the platinum group metal is platinum.

3. The electrode of claim 2 characterized in that the coating also contains at least one additional metal or oxide of zinc, cadmium, arsenic, antimony, bismuth, selenium and tellerium in a quantity up to 30% by weight of the tin.

4. The electrode of claim 1, characterised in that the coating comprises 40 to 85 parts by weight of platinum, 0 to 20 parts by weight of palladium and 15 to 40 parts by weight of tin.

5. The electrode of claim 4 characterized in that the coating also contains at least one additional metal or oxide of zinc, cadmium, arsenic, antimony, bismuth, selenium and tellerium in a quantity up to 30% by weight of the tin.

6. The electrode of claim 1, characterized in that the coating also contains at least one additional metal or oxide of zinc, cadmium, arsenic, antimony, bismuth, selenium and tellerium in a quantity up to 30% by weight of the tin.

7. The electrode of claim 6, characterized in that the coating contains one or more oxides of antimony and/or bismuth in an amount of at most 1 part by weight of Sb/Bi to 4 parts by weight of Sn.

8. A process for the production of chlorates, perchlorates and other percompounds by electrolysis, characterized by using as anode an electrode as stated in claims 1, 2, 4, 6, 7, 3 or 5.

* * * * *